US010570474B2

(12) United States Patent
Aoyama et al.

(10) Patent No.: US 10,570,474 B2
(45) Date of Patent: Feb. 25, 2020

(54) METHOD FOR MANUFACTURING HIGH-STRENGTH GALVANIZED STEEL SHEET

(71) Applicant: JFE STEEL CORPORATION, Tokyo (JP)

(72) Inventors: Mai Aoyama, Fukuyama (JP); Yoshitsugu Suzuki, Chiba (JP); Hideyuki Kimura, Fukuyama (JP)

(73) Assignee: JFE STEEL CORPORATION, Tokyo (JP)

( * ) Notice: Subject to any disclaimer, the term of this patent is extended or adjusted under 35 U.S.C. 154(b) by 364 days.

(21) Appl. No.: 15/323,163

(22) PCT Filed: Jun. 15, 2015

(86) PCT No.: PCT/JP2015/002976

§ 371 (c)(1),
(2) Date: Dec. 30, 2016

(87) PCT Pub. No.: WO2016/002141

PCT Pub. Date: Jan. 7, 2016

(65) Prior Publication Data

US 2017/0159151 A1 Jun. 8, 2017

(30) Foreign Application Priority Data

Jul. 2, 2014 (JP) ..... 2014-136461

(51) Int. Cl.

| | |
|---|---|
| ***C21D 9/46*** | (2006.01) |
| ***B21B 3/00*** | (2006.01) |
| ***C23C 2/02*** | (2006.01) |
| ***C23C 2/06*** | (2006.01) |
| ***C22C 38/06*** | (2006.01) |
| ***C22C 38/60*** | (2006.01) |
| ***B21B 1/26*** | (2006.01) |
| ***C22C 38/00*** | (2006.01) |
| ***B21B 1/28*** | (2006.01) |
| ***C23C 2/28*** | (2006.01) |
| ***B21B 1/22*** | (2006.01) |
| ***C21D 8/02*** | (2006.01) |

(Continued)

(52) U.S. Cl.

CPC ..... *C21D 9/46* (2013.01); *B21B 1/22* (2013.01); *B21B 1/26* (2013.01); *B21B 1/28* (2013.01); *B21B 3/00* (2013.01); *C21D 8/0226* (2013.01); *C21D 8/0263* (2013.01); *C21D 8/0278* (2013.01); *C22C 38/00* (2013.01); *C22C 38/001* (2013.01); *C22C 38/002* (2013.01); *C22C 38/005* (2013.01); *C22C 38/008* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/22* (2013.01); *C22C 38/26* (2013.01); *C22C 38/28* (2013.01); *C22C 38/38* (2013.01); *C22C 38/60* (2013.01); *C23C 2/02* (2013.01); *C23C 2/06* (2013.01); *C23C 2/28* (2013.01); *C23C 2/40* (2013.01); *C23G 1/00* (2013.01); *B21B 2001/225* (2013.01)

(58) Field of Classification Search

CPC .... C23C 2/06; C23C 2/02; C23C 2/40; C23C 2/28; C21D 2211/005; C21D 8/0226; C21D 9/46; C21D 2211/008; C21D 8/0236; C21D 8/0263; C21D 2211/009; C21D 1/26; C21D 2211/001; C21D 2211/002; C21D 6/004; C21D 6/005; C21D 6/008; C21D 8/0205; C21D 8/0278; C21D 8/0473; C21D 9/48; C21D 1/185; C21D 1/76; C21D 2211/004; C21D 8/0247; C21D 8/0273; C21D 8/0436; C21D 8/0463; C21D 9/561; B21B 1/22; B21B 1/26; B21B 1/28; B21B 2001/225; B21B 3/00

USPC ..... 148/533

See application file for complete search history.

(56) References Cited

U.S. PATENT DOCUMENTS 3,826,693 A * 7/1974 Fisher ..... C21D 8/0273 148/634
2003/0054195 A1* 3/2003 Ishii ..... C21D 8/0278 428/653

FOREIGN PATENT DOCUMENTS

CN 1701130 A 11/2005
JP 2587724 B2 3/1997

(Continued)

OTHER PUBLICATIONS

Nov. 6, 2017 Office Action issued in Chinese Patent Application No. 201580034963.6.

(Continued)

*Primary Examiner* — Colleen P Dunn
*Assistant Examiner* — Nicholas A Wang
(74) *Attorney, Agent, or Firm* — Oliff PLC

(57) ABSTRACT

A method for manufacturing a high-strength galvanized steel sheet. The method includes a first heating step of holding the steel sheet in a temperature range of 750° C. to 880° C. for 20 s to 600 s in an atmosphere having an $H_2$ concentration of 0.05% to 25.0% by volume and a dew point of −45° C. to −10° C., a cooling step, a rolling step of rolling the steel sheet with a rolling reduction of 0.3% to 2.0%, a pickling step of pickling the steel sheet with a pickling weight loss of 0.02 gram/$m^2$ to 5 gram/$m^2$ in terms of Fe, a second heating step of holding the steel sheet in a temperature range of 720° C. to 860° C. for 20 sec. to 300 sec. in an atmosphere having an $H_2$ concentration of 0.05% to 25.0% by volume and a dew point of −10° C. or lower, and a galvanizing step.

5 Claims, No Drawings

(51) Int. Cl.

| | |
|---|---|
| ***C22C 38/02*** | (2006.01) |
| ***C22C 38/04*** | (2006.01) |
| ***C22C 38/08*** | (2006.01) |
| ***C22C 38/12*** | (2006.01) |
| ***C22C 38/14*** | (2006.01) |
| ***C22C 38/16*** | (2006.01) |
| ***C22C 38/22*** | (2006.01) |
| ***C22C 38/26*** | (2006.01) |
| ***C22C 38/28*** | (2006.01) |
| ***C22C 38/38*** | (2006.01) |
| ***C23C 2/40*** | (2006.01) |
| ***C23G 1/00*** | (2006.01) |

(56) References Cited

FOREIGN PATENT DOCUMENTS

| | | | |
|---|---|---|---|
| JP | 2000-290730 | A | 10/2000 |
| JP | 2002-173714 | A | 6/2002 |
| JP | 2004-263271 | A | 9/2004 |
| JP | 2004-263295 | A | 9/2004 |
| JP | 3956550 | B2 | 8/2007 |
| JP | 2014-019905 | A | 2/2014 |

OTHER PUBLICATIONS

Sep. 15, 2015 International Search Report issued in Patent Application No. PCT/JP2015/002976.

* cited by examiner

METHOD FOR MANUFACTURING HIGH-STRENGTH GALVANIZED STEEL SHEET

TECHNICAL FIELD

The present disclosure relates to a method for manufacturing a high-strength galvanized steel sheet suitable for use in automotive parts applications.

BACKGROUND ART

In recent years, with the rising awareness of global environmental protection, improvements in fuel efficiency have been strongly required for reducing automobile $CO_2$ emissions. This has led to active attempts to reduce the thickness of automotive parts by strengthening steel sheets, which are materials for automobile body parts, to reduce automobile weight.

In order to strengthen steel sheets, solid solution-strengthening elements such as Si and Mn are added. However, these elements are more oxidizable than Fe. Therefore, in the case of manufacturing galvanized steel sheets and galvannealed steel sheets from high-strength steel sheets containing large amounts of these elements, there are problems below.

In usual, in order to manufacture a galvanized steel sheet, after a steel sheet is heated and annealed at a temperature of about 600° C. to 900° C. a non-oxidizing atmosphere or a reducing atmosphere, the steel sheet is galvanized. Oxidizable elements in steel are selectively oxidized in a non-oxidizing atmosphere or reducing atmosphere generally used and concentrate on surfaces to form oxides on surfaces of the steel sheet. The oxides reduce the wettability between the steel sheet surfaces and molten zinc to cause bare spots. The increase in concentration of each oxidizable element in steel sharply reduces the wettability to cause many bare spots. Even in the case where no bare spots are caused, the oxides are present between the steel sheet and a coating and therefore the adhesion of the coating is deteriorated. In particular, the addition of even a small amount of Si significantly reduces the wettability with molten zinc. Therefore, in galvanized steel sheets, Mn, which has a small influence on wettability, is often added. However, Mn oxides also reduce the wettability with molten zinc. Therefore, in the case of the addition of a large amount of Mn, a problem with the above bare spots is significant.

In order to cope with the problem, Patent Literature 1 proposes a method for improving the wettability of a surface of a steel sheet with molten zinc in such a manner that the steel sheet is heated in an oxidizing atmosphere in advance, the oxidation of an added element on the steel sheet surface by rapidly forming an Fe oxide film on the surface at a predetermined oxidation rate or more, and the Fe oxide film is then reductively annealed. However, when the oxidation of the steel sheet is significant, there is a problem in that iron oxide adheres to a roll in a furnace to cause scratches on the steel sheet. In addition, Mn forms a solid solution in the Fe oxide film and therefore is likely to form Mn oxides on the steel sheet surface during reductive annealing; hence, the effect of oxidation treatment is small.

Patent Literature 2 proposes a method in which a steel sheet is pickled after annealing, surface oxides are thereby removed, and the steel sheet is annealed again and is then galvanized. However, when the amount of an added alloying element is large, surface oxides are formed again during re-annealing. Therefore, even in the case where no bare spots are caused, there is a problem in that the adhesion of a coating is deteriorated.

CITATION LIST

Patent Literature

[PTL 1] Japanese Patent No. 2587724 (Japanese Unexamined Patent Application Publication No. 4-202630)

[PTL 2] Japanese Patent No. 3956550 (Japanese Unexamined Patent Application Publication No. 2000-290730)

SUMMARY

Technical Problem

In view of the above circumstances, it is an object of the present disclosure to provide a method for manufacturing a high-strength galvanized steel sheet excellent in coating adhesion and surface appearance.

Solution to Problem

The inventors have conducted intensive investigations to manufacture a steel sheet which contains Mn and which is excellent in surface appearance and coat adhesion and have found the following.

The following method is effective in improving the surface appearance of a steel sheet containing Mn: a method in which pickling is performed after annealing, re-annealing performed, and galvanizing is then performed as described in Patent Literature 2. However, when a large amount of Mn is contained, it is difficult to completely suppress the formation of oxides during re-annealing as described above and therefore the adhesion of a coating is poor in some cases. Thus, a means for enhancing the coating adhesion is necessary.

In order to enhance the coating adhesion, a technique for forming fine irregularities by roughening a surface of a steel sheet is used. Examples of the technique for forming the fine irregularities include a method for grinding a surface of a steel sheet and a shot-blasting method. These methods require a new facility in a manufacturing line and therefore cost significantly. As a result of investigating methods for imparting fine irregularities to surfaces of steel sheets at low cost using an existing facility, a method below has been established. When a steel sheet containing Mn is annealed, spherical or massive oxides containing Mn are formed on a surface of the steel sheet. The oxides containing Mn are pushed into the steel sheet by rolling and are then removed, whereby a steel sheet having fine irregularities formed on a surface thereof can be obtained.

The present disclosure is based on the above finding. Exemplary disclosed embodiments include as follows.

(1) A method for manufacturing a high-strength galvanized steel sheet includes a first heating step of holding a steel sheet containing 0.040% to 0.500% C, 0.80% or less Si, 1.80% to 4.00% Mn, 0.100% or less P, 0.0100 or less S, 0.100% or less Al, and 0.0100% or less N as a composition on a mass basis, the remainder being Fe and inevitable impurities, in a temperature range of 750° C. to 880° C. for 20 sec. to 600 sec. in an atmosphere having an $H_2$ concentration of 0.05% to 25.0% by volume and a dew point of −45° C. to −10° C., a cooling step of cooling the steel sheet after the first heating step, a rolling step of rolling the steel sheet with a rolling reduction of 0.3% to 2.0% after the cooling step, a pickling step of pickling the steel sheet with a pickling weight loss of 0.02 gram/$m^2$ to 5 gram/$m^2$ in terms of Fe after the rolling step, a second heating step of holding the steel sheet in a temperature range of 720° C. to 860° C. for 20 sec. to 300 sec. in an atmosphere having an $H_2$ concentration of 0.05% to 25.0% by volume and a dew point of −10° C. or lower after the pickling step, and a galvanizing step of galvanizing the steel sheet after the second heating step.

(2) in the method for manufacturing the high-strength galvanized steel sheet specified in item (1), at least one element selected from 0.010% to 0.100% Ti, 0.010% to 0.100% Nb, and 0.0001% to 0.0050% 3 on a mass basis is further contained as a composition.

(3) In the method for manufacturing the high-strength galvanized steel sheet specified in Item (1) or (2), at least one element selected from 0.01% to 0.50% Mo, 0.30% or less 0.50% or less Ni, 1.00% or less Cu, 0.500% or less V, 0.10% or less Sb, 0.10% or less Sn, 0.0100% or less Ca, and 0.010% or less of a REM on a mass basis is further contained as a composition.

(4) In the method for manufacturing the high-strength galvanized steel sheet specified in any one of Items (1) to (3), in the manufacture of the steel sheet subjected to the first heating step, after a steel slab is hot-rolled and is then descaled by pickling, a heat treatment step is performed in such a manner that the steel sheet is held at a temperature of 600° C. or higher for 600 sec. to 21,600 sec. in an atmosphere having an $H_2$ concentration of 1.0% to 25.0% by volume and a dew point of 10° C. or lower in such a state that no surface of the sheet is exposed to the atmosphere.

(5) The method for manufacturing the high-strength galvanized steel sheet specified in any one of Items (1) to (4) further includes an alloying treatment step of alloying the steel sheet after the galvanizing step.

In the present disclosure, the term "high-strength galvanized steel sheet" refers to a steel sheet with a tensile strength (TS) of 780 MPa or more and the term "galvanized steel sheet" includes a plated steel sheet (hereinafter referred to as "GI" in some cases) not alloyed after galvanizing and a plated steel sheet (hereinafter referred to as "GA" in some cases) alloyed after galvanizing.

Advantageous Effects

According to the present disclosure, a high-strength galvanized steel sheet excellent in surface appearance and coating adhesion is obtained. Applying a high-strength galvanized steel sheet according to the present disclosure to, for example, automobile structural parts enables the improvement in fuel consumption due to the reduction of automobile weight to be achieved.

DESCRIPTION OF EMBODIMENTS

Embodiments of the present disclosure are as described below. The present disclosure is not limited to the embodiments. The unit "%" used to express the content of each component refers to "mass percent".

First, the composition is described. The following components are contained, the remainder being Fe and inevitable impurities: 0.040% to 0.500% C, 0.80% or less Si, 1.80% to 4.00% Mn, 0.100% or less P, 0.0100% or less S, 0.100% or less Al, and 0.0100% or less N. In addition to the above components, at least one element selected from 0.010% to 0.100% Ti, 0.010% to 0.100% Nb, and 0.0001% to 0.0050% B may be further contained. In addition to the above components, at least one element selected from 0.01% to 0.50% Mo, 0.30% or less Cr, 0.50% or less Ni, 1.00% or less Cu, 0,500% or less V, 0.10% or less Sb, 0.10% or less Sn, 0.0100% or less Ca, and 0.010% or less of a REM may be further contained. The components are described below.

C: 0.040% to 0.500%

C is an austenite-producing element and is also an element which is effective in multiplexing the microstructure of an annealed steel sheet to increase the strength and ductility thereof. In order to increase the strength and the ductility, the content of C is set to 0.040% or more. However, when the content of C is more than 0.500%, the hardening of a weld and a heat-affected zone is significant, mechanical characteristics of the weld are deteriorated, and spot weldability and arc weldability are reduced. Therefore, the content of C is set to 0.500% or less.

Si: 0.80% or Less

Si is a ferrite-producing element and is also an element effective in enhancing the solid solution strengthening and work hardenability of ferrite in an annealed steel sheet. When the content of Si is more than 0.80%, Si forms an oxide on a surface of a steel sheet during annealing to deteriorate the wettability of a coating. Thus, the content of Si is set to 0.80% or less.

Mn: 1.80% to 4.00%

Mn is an austenite-producing element and is also an element effective ensuring the strength of an annealed steel sheet. In order to ensure the strength thereof, the content of Mn is set to 1.80% or more. However, when the content of Mn is more than 4.00%, a surface layer containing large amounts of oxides formed on a surface of a steel sheet during annealing deteriorates the appearance of a coating. Therefore, the content of Mn is set to 4.00% or less.

P: 0.100% or Less

P is an element effective in strengthening steel. From the viewpoint of strengthening steel, the content of P is preferably 0.001% or more. However, the content of P is re than 0.100%, intergranular segregation causes embrittlement to deteriorate crashworthiness. Thus, the content of P is set to 0.100% or less.

S: 0.0100% or Less

S forms inclusions such as MnS to cause the deterioration of crashworthiness or cracks along metal flows in welds. Therefore, the content of S is preferably as low as possible. Thus, the content of S is set to 0.0100% or less.

Al: 0.100% or Less

The excessive addition of Al increases the amounts of oxide inclusions to cause the deterioration of surface quality and formability and leads to high costs. Therefore, the content of Al is preferably set to 100 or less and more preferably 0.050% or less.

N: 0.0100% or Less

N is an element deteriorating the aging resistance of steel and is preferably small in amount. When the content of N is more than 0.0100%, the deterioration of aging resistance is significant. Thus, the content of N is set to 0.0100% or less.

The remainder are Fe and the inevitable impurities. A high-strength galvanized steel sheet according to the present disclosure may contain elements below as required for the purpose of achieving high strength and the like.

Ti: 0.010% to 0.100%

Ti is an element which forms fine carbides or nitrides with C or N, respectively, in a steel sheet to contribute to the increase in strength of the steel sheet. In order to obtain this effect, the content of Ti is preferably 0.010% or more.

However, when the content of Ti is more than 0.100%, this effect is saturated. Therefore, the content of Ti is preferably 0.100% or less.

Nb: 0.010% to 0.100%

Nb is an element, contributing to the increase of strength by solid solution strengthening or precipitation strengthening. In order to obtain this effect, the content of Nb is preferably 0.010% or more. However, when the content of Nb is more than 0.100%, the ductility of a steel sheet is reduced and the workability thereof is deteriorated in some cases. Therefore, the content of Nb is preferably 0.100% or less.

B: 0.0001% to 0.0050%

B is an element which increases the hardenability of a steel sheet to contribute to the increase in strength of the steel sheet. In order to obtain this effect, the content of B is preferably 0.0001% or more. However, containing an excessive amount of B causes a reduction in ductility to deteriorate workability in some cases. Furthermore, containing an excessive amount of B causes cost increases. Therefore, the content of B is preferably 0.0050% or less.

Mo: 0.01% to 0.50%

Mo is an austenite-producing element and is also an element effective in ensuring the strength of an annealed steel sheet. From the viewpoint of ensuring the strength thereof, the content of Mo is preferably 0.01% or more. However, Mo is high in alloying cost and therefore a high Mo content causes cost increases. Therefore, the content of Mo is preferably 0.50% or less.

Cr: 0.30% or Less

Cr is an austenite-producing element and is also an element effective in ensuring the strength of an annealed steel sheet. Then the content of Cr is more than 0.30%, oxides are formed on a surface of a steel sheet during annealing to deteriorate the appearance of a coating in some cases. Therefore, the content of Cr is preferably 0.30% or less.

Ni: 0.50% or Less, Cu: 1.00% or Less, V: 0.500% or Less

Ni, Cu, and V are elements effective in strengthening steel and may be used to strengthen steel within a range specified in the present disclosure. In order to strengthen steel, the content of Ni is preferably 0.05% or more, the content of Cu is preferably 0.05% or more, and the content of V is preferably 0.005% or more. However, the excessive addition of more than 0.50% Ni, more than 1.00% Cu, and more than 0.500% V causes concerns about a reduction in ductility due to a significant increase in strength in some cases. Furthermore, containing excessive amounts of these elements causes cost increases. Thus, when these elements are contained, the content of Ni is preferably 0.50% or less, the content of Cu is preferably 1.00% or less, and the content of V is preferably 0.500% or less.

Sb: 0.10% or Less, Sn: 0.10% or Less

Sb and Sn have the ability to suppress nitrogenation near a surface of a steel sheet. In order to suppress nitrogenation, the content of Sb is preferably 0.005% or more and the content of Sn is preferably 0.005% or more. However, when the content of Sb and the content of Sn are more than 0.10%, the above effect is saturated. Thus, when these elements are contained, the content of Sb is preferably 0.10% or less and the content of Sn is preferably 0.10% or less.

Ca: 0.0100% or Less

Ca has the effect of enhancing ductility by controlling the shape of sulfides such as MnS. In order to obtain this effect, the content of Ca is preferably 0.0010% or more. However, when the content of Ca is more than 0.0100%, this effect is saturated. Therefore, when Ca is contained, the content of Ca is preferably 0.0100% or less.

REM: 0.010% or Less

The REM controls the morphology of sulfide inclusions to contribute to the enhancement of workability. In order to obtain the effect of enhancing workability, the content of the REM is preferably 0.001% or more. When the content of the REM is more than 0.010%, the amounts of inclusions are increased and workability is deteriorated in some cases. Thus, when the REM is contained, the content of the REM is preferably 0.010% or less.

A method for manufacturing the high-strength galvanized steel sheet according to the present disclosure is described below.

A steel slab having the above composition is subjected to rough rolling and finish rolling in a hot rolling step. Thereafter, a surface layer of a hot-rolled plate is descaled in a pickling step and the hot-rolled plate is cold-rolled. Herein, conditions of the hot rolling step, conditions of the pickling step, and conditions of a cold rolling step are not particularly limited and may be appropriately set. Manufacturing may be performed by thin strip casting in such a manner that a portion or the whole of the hot rolling step is omitted. In a period which follows the pickling step and which is prior to the cold rolling step, a heat treatment step may be performed as required in such a manner that the steel sheet is held at a temperature of 600° C. or higher for 600 sec. to 21,600 sec. in an atmosphere having an $H_2$ concentration of 1.0% to 25.0% by volume and a dew point of 10° C. or lower in such a state that no surface of the steel sheet is exposed to the atmosphere (for example, a tight coil state). Herein, the unit for the holding time means "second or sec.".

The heat treatment step is described below in detail.

The heating step is a step in which the steel sheet subjected to the pickling step is held at a temperature of 600° C. or higher for a time of 600 sec. to 21,600 sec. in an atmosphere having an $H_2$ concentration of 1.0% to 25.0% by volume and a dew point of 10° C. or lower in such a state that no surface of the steel sheet is exposed to the atmosphere.

The heat treatment step is performed for the purpose of concentrating Mn in an austenite phase in the steel sheet after hot rolling. In general, hot-rolled steel sheets have a microstructure composed of a plurality of phases such as a ferrite phase, an austenite phase, a pearlite phase, a bainite phase, and a cementite phase. Concentrating Mn in the austenite phase is expected to enhance the ductility of a galvanized steel sheet which is a final product.

When the temperature or holding time in the heat treatment step is lower than 600° C. or 600 sec, respectively, the concentration of Mn in the austenite phase may not possibly proceed. The upper limit of the temperature is not particularly limited. When the temperature is higher than 850° C., the concentration of Mn in the austenite phase is saturated and cost increases arise. Thus, the temperature is preferably 850° C. or lower. On the other hand, when the steel sheet is held for more than 21,600 sec, the concentration of Mn in the austenite phase is saturated, an effect on the ductility of a final product is small, and cost increases arise. Thus, heat treatment is preferably performed at a temperature of 600° C. or higher for a holding time of 600 sec. to 21,600 sec.

In the heat treatment step, in order to avoid influences on a first heating step and second heating step following the heat treatment step, the surface oxidation of the steel sheet is suppressed during heat treatment for a long time. Therefore, no surface of the steel sheet is preferably exposed to any atmosphere. The expression "no surface of the steel sheet is exposed to any atmosphere" includes not only a state in which both surfaces of the steel sheet are not exposed to any atmosphere but also a state in which a surface of the steel sheet is not exposed to any atmosphere. Thickness surfaces of the steel sheet are end surfaces thereof and do not correspond to the above surface. In order to maintain a state in which no surface of the steel sheet is exposed to any atmosphere, for example, the following method is cited: a method, such as vacuum annealing, for completely blocking an atmosphere. This method has a significant problem with cost. On the basis of a usual step, the ingress of an atmosphere between portions of the steel sheet can be suppressed in such a manner that the coiled sheet steel is tightly coiled such that a so-called tight coil is formed. Incidentally, the outermost peripheral surface of a coil is usually near a weld during heating in a downstream step and is removed from a product. In the case where heating is not performed in a continuous line, the outermost peripheral surface is removed, whereby a product is obtained.

Even in the case where the tight coil is formed, an end surface of the coil is oxidized in an atmosphere in which Fe is oxidized, an inner portion of the coil is corroded, and therefore the coating appearance of a final product may possibly be impaired. Thus, in order to suppress the oxidation of Fe during heat treatment for a long time, the concentration of $H_2$ is preferably 1.0% by volume or more, which is a sufficient level. An $H_2$ concentration of more than 25.0% by volume leads to cost increases. Thus, the concentration of $H_2$ is preferably 1.0% to 25.0% by volume. The remainder other than $H_2$ are $N_2$, $H_2O$, and inevitable impurities.

Likewise, when the dew point is higher than 10° C., be in an end surface of the coil may possibly be oxidized. Therefore, the dew point is preferably 10° C. or lower.

Next, steps which are important requirements for the present disclosure are performed as described below. The following steps are performed: a first heating step of holding the steel sheet in a temperature range of 750° C. to 880° C. for 20 sec. to 600 ec. in an atmosphere having an $H_2$ concentration of 0.05% to 25.0% by volume and a dew point of −45° C. to −10° C., a cooling step of cooling the steel sheet after the first heating step, a rolling step of rolling the steel sheet with a rolling reduction of 0.3% to 2.0% after the cooling step, a pickling step of pickling the steel sheet with a pickling weight loss of 0.02 gram/$m^2$ to 5 gram/$m^2$ in terms of Fe after the rolling step, a second heating step of holding the steel sheet at an arbitrary temperature of 720° C. to 860° C. or in a temperature range of 720° C. to 860° C. for 20 sec. to 300 sec. in an atmosphere having an $H_2$ concentration of 0.05% to 25.0% by volume and a dew point of −10° C. or lower after the pickling step, and a galvanizing step of galvanizing the steel sheet after the second heating step. The unit "s" for the holding time in the first and second heating steps means "seconds". The first heating step, the cooling step, the rolling step, the pickling step, the second heating step, and the galvanizing step may be performed in a continuous line or separate lines. The steps are described below in detail.

First Heating Step

The first heating step is a step of holding the steel sheet in a temperature range of 750° C. to 880° C. for 0.0 sec. to 600 sec, in an atmosphere having an $H_2$ concentration of 0.05% to 25.0% by volume and a dew point of −45° C. to −10° C. in the first heating step, Mn is oxidized on a surface of the steel sheet without oxidizing Fe.

The $H_2$ concentration needs to be a level sufficient to suppress the oxidation of Fe and is set to 0.05% by volume or more. However, when the $H_2$ concentration is more than 25.0% by volume, cost increases arise. Therefore, the $H_2$ concentration is set to 25.0% by volume or less. The remainder are $N_2$, $H_2O$, and inevitable impurities.

When the dew point is lower than −45° C., the oxidation of Mn is suppressed. When the dew point is higher than −10° C., Fe is oxidized. Thus, the dew point is set to a temperature of −45° C. to −10° C.

When the temperature of the steel sheet is lower than 750° C., Mn is not sufficiently oxidized. When the temperature of the steel sheet is higher than 880° C., heat costs are high. Thus, the heating temperature of the held steel sheet (the temperature of the steel sheet) is set to a temperature range of 750° C. to 880° C. In the first heating step, the steel sheet may be held at a constant temperature steel sheet is varied in a temperature range of 750° C. to 880° C.

When the holding time is less than 20 sec, Mn oxides are not sufficiently formed on a surface. When the holding time is more than 600 sec, the excessive formation of Mn oxides reduces the efficiency of pickling to reduce the manufacturing efficiency. Thus, the holding time is set to 20 sec. to 600 sec.

Cooling Step

The steel sheet is cooled to a temperature at which the steel sheet can be rolled.

Rolling Step

The cooled steel sheet is rolled with a rolling reduction of 0.3% to 2.0%. This step is performed for the purpose of increasing the coating adhesion in such a manner that the steel sheet is lightly rolled after the first heating step and oxides formed on surfaces of the steel sheet are thereby pushed into the steel sheet surfaces such that fine irregularities are imparted to the steel sheet surfaces. When the rolling reduction is less than 0.3% or less, irregularities cannot be sufficiently imparted to the steel sheet surfaces in some cases. When the rolling reduction is more than 2.0%, a lot of strain introduced into the steel sheet, pickling is promoted in the next pickling step, and therefore irregularities formed in the rolling step are eliminated in some cases. Thus, the rolling reduction is set to 0.3% to 2.0%.

Pickling Step

Surfaces of the steel sheet are pickled with a pickling weight loss of 0.02 gram/$m^2$ to 5 gram/$m^2$ in terms of Fe after the rolling step. This step is performed for the purpose of cleaning the steel sheet surfaces and the purpose of removing oxides, formed on the steel sheet surfaces in the first heating step, soluble in acid.

When the pickling weight loss is less than 0.02 gram/$m^2$ in terms of Fe, the oxides are not sufficiently removed in some cases. When the pickling weight loss is more than 5 gram $m^2$, not only the oxides on the steel sheet surfaces but also an inner portion of the steel sheet that has a reduced Mn concentration are dissolved in some cases and the formation of Mn oxides cannot be suppressed in the second heating step in some cases. Thus, the pickling weight loss is set to 0.02 gram/$m^2$ to 5 gram/$m^2$ in terms of Fe.

The Fe conversion value of the pickling weight loss is determined from the change in concentration of Fe in a pickling solution before and after processing and the area of a processed sheet.

Second Heating Step

The pickled steel sheet is held in a temperature range of 720° C. to 860° C. for 20 sec, to 300 sec. in an atmosphere having an $H_2$ concentration of 0.05% to 25.0% by volume and a dew point of −10° C. or lower. The second heating step is performed for the purpose of activating surfaces of the steel sheet to plate the steel sheet.

The $H_2$ concentration needs to be a level sufficient to suppress the oxidation of Fe and is set to 0.05% by volume or more. However, when the $H_2$ concentration is more than 25.0% by volume, cost increases arise. Therefore, the $H_2$ concentration is set to 25.0% by volume or less. The remainder are $N_2$, $H_2O$, and inevitable impurities.

When the dew point is higher than −10° C., Fe is oxidized. Therefore, the dew point is set to −10° C. or lower.

When the temperature of the steel sheet is lower than 720° C., surfaces of the steel sheet are not activated and therefore have low wettability with molten zinc. However, when the temperature of the steel sheet is higher than 860° C., Mn forms oxides on the surfaces during annealing to form surface layers containing Mn oxides and therefore reduces the wettability of the steel sheet with molten zinc. Thus, the heating temperature of the held steel sheet (the temperature of the steel sheet) is set to a temperature range of 720° C. to 860° C. the second heating step, the steel sheet may be held at a constant temperature or may be held in such a manner that the temperature of the steel sheet is varied.

When the holding time is less than 20 sec, the steel sheet surfaces are not sufficiently activated. When the holding time is more than 300 sec, Mn forms oxides on the surfaces again to form surface layers containing Mn oxides and therefore reduces the wettability with molten zinc. Thus, the holding time is set to 20 sec. to 300 sec.

Galvanizing Step

The galvanizing step is a step in which after being treated as described above, the steel sheet is cooled, is immersed in a zinc molten, bath, and is thereby galvanized.

In the case of manufacturing a galvanized steel sheet, a zinc molten bath having a temperature of 440° C. to 550° C. and an Al concentration of 0.14% to 0.24% is preferably used.

When the temperature of the bath is lower than 440° C., Zn may possibly be solidified by temperature changes in a low-temperature portion in the bath, resulting in inadequacy. When the bath temperature is higher than 550° C., the vaporization of the bath is significant and evaporated Zn adheres to the inside of a furnace to cause operational problems in some cases. Furthermore, alloying proceeds during galvanizing and therefore over alloying is likely to occur.

When the concentration of Al in the bath is less than 0.14% in the course of manufacturing the galvanized steel sheet, the alloying of Fe—Zn proceeds to impair coating adhesion in some cases. When the concentration of Al is more than 0.248, defects are caused by Al oxides in some cases.

In the case of performing alloying after galvanizing, a zinc molten bath with an Al concentration of 0.10% to 0.20% is preferably used. When the concentration of Al in the bath is less than 0.10%, a large amount of a Γ phase is produced to impair powdering properties in some cases. When the concentration of Al is more than 0.200 the alloying of Fe—Zn does not proceed in some cases.

Alloying Treatment Step

The steel sheet is alloyed after the galvanizing step as required. Conditions for alloying are not particularly limited. The alloying temperature is preferably higher than 460° C. to lower than 580° C. When the alloying temperature is 460° C. or lower, alloying proceeds slowly. When the alloying temperature is 580° C. or higher, hard brittle Fe—Zn alloy layers are excessively produced by over-alloying at base metal interfaces to deteriorate coating adhesion in some cases.

Examples

Each steel containing components shown in Table 1, the remainder being Fe and inevitable impurities, was produced in a converter and was then formed into a slab by a continuous casting process. The obtained slab was heated to 1,200° C. and was hot-rolled to a thickness of 2.3 mm to 4.5 mm, followed by coiling. Next, an obtained hot-rolled plate was pickled, was heat-treated as required, and was then cold-rolled. Thereafter, a first heating step, a cooling step, a rolling step, a pickling step, and a second heating step were performed in an atmosphere-adjustable furnace under conditions shown in Tables 2 to 6. Cooling to 100° C. or lower was performed. Subsequently, a galvanizing step was performed. Galvanizing was performed in a Zn bath containing 0.14% to 0.24% Al under conditions shown in Tables 2 to 6, whereby a galvanized steel sheet was obtained. Some of steel sheets were plated in a Zn bath containing 0.10% to 2.0% Al and were then alloyed under conditions shown in Tables 2 to 6.

The galvanized steel sheets obtained as described above were investigated for strength, total elongation, surface appearance, and coating adhesion by methods below.

<Tensile Strength and Total Elongation>

A tensile test was performed in accordance with JIS Z 2241 using a JIS No. 5 test specimen that was sampled such that tensile directions were perpendicular to the rolling direction of each steel sheet, whereby TS (tensile strength) and EL (total elongation) were measured.

<Surface Appearance>

Whether appearance defects such as pinholes and bare spots were present was visually checked. The case where no appearance defect was present was judged to be good (A). The case where a few appearance defects were present was judged to be almost good (B). The case where appearance defects were present was judged to be (C).

<Coating Adhesion>

Galvannealed steel sheets (GA) were evaluated for coating adhesion by evaluating powdering resistance. In particular, a cellophane tape was stuck to each galvannealed steel sheet, a surface of the tape was bent to 90 degrees and was then bent back, a cellophane tape with a width of 24 mm was pressed against the inside (compressed side) of a worked portion in parallel to the worked portion and was separated therefrom, and the amount of zinc attached to a 40 mm long portion of this cellophane tape was measured as the number of Zn counts using a fluorescent X-ray. On the basis of a value converted from the number of Zn counts per unit length (1 mm), those ranked 2 or lower were rated particularly good (A), those ranked 3 were rated good (B), and those ranked 4 or higher were rated poor (C) in the light of standards below.

| Number of fluorescent X-ray counts | Rank |
|---|---|
| 0 to less than 2,000 | 1 (good) |
| 2,000 to less than 5,000 | 2 |
| 5,000 to less than 8,000 | 3 |
| 8,000 to less than 10,000 | 4 |
| 10,000 or more | 5 (poor) |

For GI, a ball impact test was performed, a cellophane tape was peeled from a worked portion, and whether a coating layer was peeled off was visually checked, whereby coating adhesion was evaluated. Incidentally, the ball impact test was performed with a ball mass of 1.8 kg and a drop height of 100 cm.

A: no peeled coating layer

B: peeled coating layer

Results obtained from the above evaluation are shown in Tables 2 to 6 together with conditions.

TABLE 1

| Steel symbol | C | Si | Mn | P | S | Al | N | Ti | Nb | B | Mo |
|---|---|---|---|---|---|---|---|---|---|---|---|
| A | 0.082 | 0.21 | 3.15 | 0.007 | 0.0010 | 0.031 | 0.0038 | 0.021 | 0.045 | 0.0012 | — |
| B | 0.146 | 0.12 | 3.09 | 0.005 | 0.0007 | 0.043 | 0.0030 | 0.034 | 0.039 | 0.0015 | — |
| C | 0.079 | 0.23 | 2.58 | 0.008 | 0.0008 | 0.024 | 0.0035 | 0.018 | 0.040 | 0.0010 | 0.19 |
| D | 0.151 | 0.12 | 2.64 | 0.007 | 0.0012 | 0.033 | 0.0040 | 0.023 | 0.042 | 0.0015 | 0.17 |
| E | 0.095 | 0.13 | 3.41 | 0.007 | 0.0008 | 0.029 | 0.0034 | 0.025 | 0.051 | — | — |
| F | 0.165 | 0.19 | 1.84 | 0.006 | 0.0016 | 0.037 | 0.0029 | 0.033 | 0.027 | — | — |
| G | 0.153 | 0.51 | 3.24 | 0.004 | 0.0011 | 0.041 | 0.0038 | 0.027 | 0.038 | — | — |
| H | 0.144 | 0.48 | 2.61 | 0.004 | 0.0009 | 0.034 | 0.0031 | 0.018 | 0.043 | — | 0.12 |
| I | 0.097 | 0.22 | 2.42 | 0.008 | 0.0023 | 0.084 | 0.0035 | 0.031 | 0.040 | 0.0030 | — |
| J | 0.089 | 0.18 | 2.59 | 0.007 | 0.0015 | 0.025 | 0.0027 | 0.023 | 0.032 | — | — |
| K | 0.142 | 0.15 | 2.94 | 0.005 | 0.0007 | 0.035 | 0.0042 | 0.027 | 0.044 | — | 0.26 |
| L | 0.089 | 0.24 | 2.48 | 0.009 | 0.0009 | 0.044 | 0.0034 | 0.035 | 0.027 | — | — |
| M | 0.094 | 0.07 | 3.31 | 0.012 | 0.0005 | 0.021 | 0.0029 | 0.043 | 0.038 | — | — |
| N | 0.128 | 0.11 | 3.24 | 0.008 | 0.0012 | 0.053 | 0.0033 | 0.022 | 0.033 | — | — |
| O | 0.106 | 0.19 | 2.74 | 0.009 | 0.0010 | 0.036 | 0.0037 | 0.025 | 0.042 | — | — |
| P | 0.149 | 0.23 | 2.59 | 0.005 | 0.0008 | 0.043 | 0.0024 | 0.019 | 0.050 | — | — |
| Q | 0.103 | 0.02 | 3.72 | 0.006 | 0.0008 | 0.035 | 0.0031 | 0.021 | 0.033 | — | — |
| R | 0.094 | 0.04 | 3.54 | 0.008 | 0.0070 | 0.033 | 0.0029 | — | — | — | — |
| S | 0.085 | 0.11 | 4.50 | 0.007 | 0.0024 | 0.034 | 0.0041 | 0.034 | 0.037 | — | — |
| T | 0.095 | 1.24 | 2.23 | 0.006 | 0.0015 | 0.027 | 0.0038 | 0.024 | 0.035 | — | — |
| U | 0.152 | 0.02 | 3.56 | 0.015 | 0.0020 | 0.041 | 0.0038 | 0.042 | — | — | — |
| V | 0.149 | 0.01 | 3.92 | 0.003 | 0.0007 | 0.037 | 0.0032 | — | — | — | — |
| W | 0.163 | 0.52 | 3.45 | 0.005 | 0.0008 | 0.039 | 0.0041 | — | — | — | — |

(mass percent)

| Steel symbol | Cr | Ni | Cu | V | Sb | Sn | Ca | REM | Remarks |
|---|---|---|---|---|---|---|---|---|---|
| A | — | — | — | — | — | — | — | — | Inventive steel |
| B | — | — | — | — | — | — | — | — | Inventive steel |
| C | — | — | — | — | — | — | — | — | Inventive steel |
| D | — | — | — | — | — | — | — | — | Inventive steel |
| E | — | — | — | — | — | — | — | — | Inventive steel |
| F | — | — | — | — | — | — | — | — | Inventive steel |
| G | — | — | — | — | — | — | — | — | Inventive steel |
| H | — | — | — | — | — | — | — | — | Inventive steel |
| I | — | — | — | 0.058 | — | — | — | — | Inventive steel |
| J | — | — | 0.05 | — | — | — | — | — | Inventive steel |
| K | 0.15 | — | — | — | — | — | — | — | Inventive steel |
| L | — | — | — | — | — | 0.03 | — | — | Inventive steel |
| M | — | 0.22 | — | — | — | — | — | — | Inventive steel |
| N | — | — | — | — | — | — | 0.0018 | — | Inventive steel |
| O | — | — | — | — | — | — | — | 0.003 | Inventive steel |
| P | — | — | — | — | 0.02 | — | — | — | Inventive steel |
| Q | — | — | — | — | — | — | — | — | Inventive steel |
| R | — | — | — | — | — | — | — | — | Inventive steel |
| S | — | — | — | — | — | — | — | — | Comparative steel |
| T | — | — | — | — | — | — | — | — | Comparative steel |
| U | — | — | — | — | — | — | — | — | Inventive steel |
| V | — | — | — | — | — | — | — | — | Inventive steel |
| W | — | — | — | — | — | — | — | — | Inventive steel |

TABLE 2

| | | Heat treatment step | | | | Cold rolling step | First heating step | | | | Cooling step | Rolling step | Pickling step | Second heating |
|---|---|---|---|---|---|---|---|---|---|---|---|---|---|---|
| No. | Steel | $H_2$ (%) | Dew point (° C.) | Heating temperature (° C.) | Holding time (s) | Rolling reduction (%) | $H_2$ (%) | Dew point (° C.) | Heating temperature (° C.) | Holding time (s) | Cooling temperature (° C.) | Rolling reduction (%) | Weight loss (g/m$^2$) | step $H_2$ (%) |
| 1 | A | — | — | — | — | 50 | 8.0 | −40 | 850 | 150 | 100 | 0.5 | 0.05 | 5.0 |
| 2 | A | — | — | — | — | 50 | 8.0 | −40 | 850 | 150 | 100 | 0.9 | 0.07 | 5.0 |
| 3 | A | — | — | — | — | 50 | 5.0 | −35 | 760 | 200 | 50 | 0.7 | 0.08 | 10.0 |
| 4 | A | — | — | — | — | 50 | 10.0 | −40 | 870 | 200 | 50 | 0.7 | 0.05 | 10.0 |
| 5 | A | — | — | — | — | 50 | 8.0 | −45 | 830 | 100 | 50 | 0.9 | 0.08 | 10.0 |
| 6 | A | — | — | — | — | 50 | 5.0 | −35 | 830 | 150 | 50 | 1.8 | 0.12 | 8.0 |
| 7 | A | — | — | — | — | 50 | 10.0 | −35 | 790 | 150 | 100 | 0.4 | 0.06 | 10.0 |
| 8 | A | — | — | — | — | 50 | 10.0 | −35 | 830 | 150 | 100 | 1.2 | 0.48 | 10.0 |
| 9 | A | — | — | — | — | 50 | 8.0 | −40 | 860 | 150 | 100 | 0.7 | 0.57 | 5.0 |
| 10 | A | — | — | — | — | 50 | 7.0 | −15 | 810 | 150 | 100 | 0.7 | 0.19 | 15.0 |
| 11 | B | — | — | — | — | 50 | 10.0 | −35 | 820 | 150 | 100 | 0.5 | 0.05 | 5.0 |
| 12 | B | — | — | — | — | 50 | 10.0 | −30 | 810 | 150 | 100 | 0.9 | 0.12 | 5.0 |
| 13 | B | — | — | — | — | 50 | 5.0 | −40 | 800 | 500 | 100 | 0.7 | 2.38 | 15.0 |

TABLE 2-continued

| | | | | | | | | | | | | | | |
|---|---|---|---|---|---|---|---|---|---|---|---|---|---|---|
| 14 | B | — | — | — | — | 50 | 5.0 | −15 | 850 | 150 | 100 | 1.1 | 1.44 | 10.0 |
| 15 | B | — | — | — | — | 50 | 5.0 | −20 | 830 | 250 | 100 | 1.4 | 1.08 | 10.0 |
| 16 | B | — | — | — | — | 50 | 15.0 | −35 | 820 | 100 | 100 | 1.1 | 4.5 | 5.0 |
| 17 | B | — | — | — | — | 50 | 10.0 | −35 | 810 | 100 | 100 | 0.8 | 0.03 | 15.0 |
| 18 | B | — | — | — | — | 50 | 10.0 | −30 | 820 | 150 | 100 | 0.8 | 0.29 | 5.0 |
| 19 | B | — | — | — | — | 50 | 15.0 | −40 | 850 | 100 | 50 | 0.7 | 0.17 | 10.0 |
| 20 | B | — | — | — | — | 50 | 10.0 | −35 | 800 | 200 | 100 | 1.0 | 0.62 | 15.0 |
| 21 | C | — | — | — | — | 50 | 10.0 | −40 | 790 | 150 | 50 | 0.5 | 0.05 | 5.0 |
| 22 | C | — | — | — | — | 50 | 10.0 | −30 | 820 | 150 | 50 | 0.9 | 0.09 | 5.0 |
| 23 | C | — | — | — | — | 50 | 5.0 | −30 | 830 | 50 | 50 | 0.7 | 0.18 | 10.0 |
| 24 | C | — | — | — | — | 50 | 5.0 | −35 | 830 | 250 | 50 | 1.7 | 0.31 | 15.0 |
| 25 | C | — | — | — | — | 50 | 8.0 | −40 | 860 | 100 | 50 | 0.9 | 0.28 | 15.0 |
| 26 | C | — | — | — | — | 50 | 10.0 | −40 | 840 | 200 | 50 | 0.7 | 0.55 | 10.0 |
| 27 | C | — | — | — | — | 50 | 15.0 | −30 | 790 | 150 | 50 | 1.1 | 0.07 | 8.0 |
| 28 | C | — | — | — | — | 50 | 10.0 | −35 | 810 | 200 | 100 | 0.4 | 0.94 | 15.0 |
| 29 | C | — | — | — | — | 50 | 15.0 | −30 | 820 | 100 | 100 | 1.1 | 0.18 | 5.0 |
| 30 | C | — | — | — | — | 50 | 5.0 | −30 | 810 | 100 | 100 | 1.3 | 0.22 | 5.0 |
| 31 | D | — | — | — | — | 50 | 10.0 | −35 | 820 | 150 | 100 | 0.5 | 0.05 | 5.0 |
| 32 | D | — | — | — | — | 50 | 10.0 | −35 | 840 | 150 | 50 | 0.9 | 0.13 | 5.0 |
| 33 | D | — | — | — | — | 50 | 5.0 | −45 | 820 | 200 | 100 | 1.1 | 0.54 | 10.0 |
| 34 | D | — | — | — | — | 50 | 10.0 | −30 | 860 | 150 | 100 | 1.3 | 0.29 | 8.0 |
| 35 | D | — | — | — | — | 50 | 10.0 | −35 | 800 | 200 | 50 | 0.5 | 0.11 | 10.0 |
| 36 | D | — | — | — | — | 50 | 5.0 | −35 | 790 | 100 | 50 | 0.8 | 0.61 | 10.0 |
| 37 | D | — | — | — | — | 50 | 10.0 | −30 | 830 | 100 | 50 | 0.8 | 0.22 | 5.0 |
| 38 | D | — | — | — | — | 50 | 10.0 | −40 | 860 | 200 | 50 | 0.6 | 0.19 | 15.0 |
| 39 | D | — | — | — | — | 50 | 8.0 | −35 | 850 | 150 | 50 | 0.7 | 0.06 | 10.0 |
| 40 | D | — | — | — | — | 50 | 5.0 | −40 | 820 | 100 | 50 | 1.4 | 0.07 | 10.0 |

| | Second heating step | | | Galvanizing step | Alloying treatment step | | | | | | |
|---|---|---|---|---|---|---|---|---|---|---|---|
| No. | Dew point (° C.) | Heating temperature (° C.) | Holding time (s) | Al concentration (%) | Alloying temperature (° C.) | Tensile strength (MPa) | Total elongation (%) | Surface appearance | Adhesion | Product | Remarks |
| 1 | −35 | 800 | 100 | 0.193 | — | 823 | 22.4 | A | A | GI | Inventive steel |
| 2 | −35 | 800 | 50 | 0.137 | 520 | 826 | 21.8 | A | A | GA | Inventive steel |
| 3 | −40 | 750 | 100 | 0.134 | 540 | 796 | 23.4 | B | A | GA | Inventive steel |
| 4 | −30 | 820 | 150 | 0.142 | 550 | 869 | 19.4 | A | A | GA | Inventive steel |
| 5 | −35 | 790 | 200 | 0.195 | — | 994 | 16.8 | A | A | GI | Inventive steel |
| 6 | −35 | 750 | 100 | 0.210 | — | 802 | 21.9 | A | A | GI | Inventive steel |
| 7 | −40 | 750 | 200 | 0.138 | 520 | 795 | 21.5 | A | A | GA | Inventive steel |
| 8 | −30 | 730 | 100 | 0.189 | — | 789 | 22.6 | A | A | GI | Inventive steel |
| 9 | −45 | 850 | 50 | 0.192 | — | 1009 | 17.2 | B | A | GI | Inventive steel |
| 10 | −10 | 740 | 100 | 0.129 | 480 | 879 | 20.4 | A | A | GA | Inventive steel |
| 11 | −35 | 780 | 100 | 0.192 | — | 1123 | 13.8 | A | A | GI | Inventive steel |
| 12 | −35 | 780 | 100 | 0.137 | 520 | 1205 | 11.9 | A | A | GA | Inventive steel |
| 13 | −30 | 790 | 100 | 0.132 | 510 | 1193 | 12.3 | B | A | GA | Inventive steel |
| 14 | −40 | 820 | 200 | 0.130 | 520 | 1238 | 10.6 | A | A | GA | Inventive steel |
| 15 | −40 | 750 | 280 | 0.141 | 550 | 1241 | 10.8 | A | A | GA | Inventive steel |
| 16 | −35 | 800 | 100 | 0.149 | — | 1187 | 12.4 | B | A | GI | Inventive steel |
| 17 | −35 | 800 | 100 | 0.184 | — | 1192 | 12.1 | A | A | GI | Inventive steel |
| 18 | −25 | 760 | 200 | 0.192 | — | 1225 | 11.1 | A | A | GI | Inventive steel |
| 19 | −30 | 810 | 150 | 0.135 | 510 | 1216 | 11.5 | A | A | GA | Inventive steel |
| 20 | −30 | 800 | 50 | 0.197 | — | 1187 | 12.3 | A | A | GI | Inventive steel |
| 21 | −35 | 780 | 50 | 0.198 | — | 820 | 22.1 | A | A | GI | Inventive steel |
| 22 | −35 | 780 | 80 | 0.137 | 520 | 894 | 20.4 | A | A | GA | Inventive steel |
| 23 | −35 | 790 | 50 | 0.128 | 510 | 975 | 17.9 | B | A | GA | Inventive steel |
| 24 | −30 | 800 | 150 | 0.187 | — | 1008 | 16.8 | A | A | GI | Inventive steel |
| 25 | −40 | 720 | 200 | 0.191 | — | 986 | 17.2 | A | A | GI | Inventive steel |
| 26 | −40 | 750 | 150 | 0.205 | — | 1012 | 16.1 | A | A | GI | Inventive steel |
| 27 | −40 | 750 | 150 | 0.128 | 480 | 1034 | 16.2 | A | A | GA | Inventive steel |
| 28 | −35 | 810 | 50 | 0.135 | 540 | 995 | 17.4 | A | A | GA | Inventive steel |
| 29 | −40 | 800 | 120 | 0.193 | — | 892 | 20.5 | A | A | GI | Inventive steel |
| 30 | −30 | 800 | 100 | 0.133 | 500 | 967 | 18.9 | A | A | GA | Inventive steel |
| 31 | −35 | 790 | 50 | 0.148 | — | 1254 | 11.5 | A | A | GI | Inventive steel |
| 32 | −35 | 780 | 100 | 0.137 | 520 | 1305 | 10.9 | A | A | GA | Inventive steel |
| 33 | −30 | 760 | 50 | 0.139 | 520 | 1175 | 11.6 | A | A | GA | Inventive steel |
| 34 | −30 | 800 | 150 | 0.130 | 500 | 1208 | 11.8 | A | A | GA | Inventive steel |
| 35 | −35 | 830 | 100 | 0.184 | — | 1225 | 11.7 | A | A | GI | Inventive steel |
| 36 | −40 | 780 | 30 | 0.189 | — | 1190 | 12.4 | A | A | GI | Inventive steel |
| 37 | −40 | 830 | 50 | 0.130 | 510 | 1176 | 12.9 | A | A | GA | Inventive steel |
| 38 | −30 | 800 | 150 | 0.192 | — | 1219 | 10.9 | A | A | GI | Inventive steel |
| 39 | −35 | 820 | 100 | 0.194 | — | 1243 | 10.6 | A | A | GI | Inventive steel |
| 40 | −35 | 790 | 100 | 0.129 | 520 | 1227 | 11.4 | A | A | GA | Inventive steel |

In the units of Table 2 to 6, "S" means "Sec." and "g/mm$^2$ means "gram/mm$^2$"

TABLE 3

| | | Heat treamtent step | | | | Cold rolling step | First heating step | | | | Cooling step | Rolling step | Pickling step | Second heating |
|---|---|---|---|---|---|---|---|---|---|---|---|---|---|---|
| No. | Steel | $H_2$ (%) | Dew point (° C.) | Heating temperature (° C.) | Holding time (s) | Rolling reduction (%) | $H_2$ (%) | Dew point (° C.) | Heating temperature (° C.) | Holding time (s) | Cooling temperature (° C.) | Rolling reduction (%) | Weight loss (g/m$^2$) | step $H_2$ (%) |
| 41 | E | — | — | — | — | 50 | 15.0 | −30 | 810 | 100 | 50 | 0.9 | 0.08 | 5.0 |
| 42 | E | — | — | — | — | 50 | 5.0 | −30 | 840 | 450 | 50 | 0.9 | 0.64 | 10.0 |
| 43 | E | — | — | — | — | 50 | 5.0 | −35 | 820 | 150 | 100 | 1.2 | 0.29 | 10.0 |
| 44 | E | — | — | — | — | 50 | 10.0 | −40 | 830 | 150 | 50 | 0.7 | 0.16 | 5.0 |
| 45 | F | — | — | — | — | 50 | 15.0 | −30 | 850 | 100 | 100 | 0.8 | 0.84 | 5.0 |
| 46 | F | — | — | — | — | 50 | 10.0 | −35 | 810 | 100 | 50 | 1.5 | 0.53 | 10.0 |
| 47 | F | — | — | — | — | 50 | 5.0 | −35 | 820 | 100 | 50 | 1.5 | 0.14 | 15.0 |
| 48 | F | — | — | — | — | 50 | 15.0 | −40 | 800 | 250 | 100 | 0.7 | 0.49 | 8.0 |
| 49 | G | — | — | — | — | 50 | 5.0 | −40 | 850 | 150 | 50 | 0.8 | 0.34 | 5.0 |
| 50 | G | — | — | — | — | 50 | 5.0 | −30 | 830 | 150 | 50 | 0.8 | 0.18 | 10.0 |
| 51 | G | — | — | — | — | 50 | 15.0 | −35 | 840 | 200 | 100 | 1.4 | 0.41 | 10.0 |
| 52 | G | — | — | — | — | 50 | 10.0 | −25 | 820 | 80 | 100 | 1.1 | 0.27 | 5.0 |
| 53 | G | — | — | — | — | 50 | 8.0 | −35 | 860 | 50 | 50 | 1.2 | 1.22 | 15.0 |
| 54 | H | — | — | — | — | 50 | 7.0 | −30 | 810 | 150 | 50 | 0.7 | 0.23 | 15.0 |
| 55 | H | — | — | — | — | 50 | 8.0 | −30 | 860 | 150 | 100 | 0.9 | 0.64 | 10.0 |
| 56 | H | — | — | — | — | 50 | 10.0 | −25 | 780 | 100 | 50 | 0.6 | 0.59 | 8.0 |
| 57 | H | — | — | — | — | 50 | 5.0 | −35 | 800 | 250 | 100 | 1.1 | 2.37 | 8.0 |
| 58 | H | — | — | — | — | 50 | 5.0 | −30 | 840 | 100 | 50 | 1.5 | 0.39 | 10.0 |
| 59 | I | — | — | — | — | 50 | 5.0 | −30 | 820 | 100 | 100 | 1.4 | 0.34 | 5.0 |
| 60 | I | — | — | — | — | 50 | 10.0 | −35 | 850 | 150 | 50 | 0.7 | 0.18 | 5.0 |
| 61 | I | — | — | — | — | 50 | 5.0 | −35 | 850 | 80 | 100 | 0.9 | 0.09 | 15.0 |
| 62 | J | — | — | — | — | 50 | 15.0 | −35 | 860 | 100 | 100 | 0.8 | 0.54 | 12.0 |
| 63 | K | — | — | — | — | 50 | 5.0 | −40 | 800 | 200 | 100 | 0.7 | 0.52 | 15.0 |
| 64 | K | — | — | — | — | 50 | 10.0 | −30 | 810 | 250 | 50 | 0.9 | 0.46 | 8.0 |
| 65 | K | — | — | — | — | 50 | 8.0 | −40 | 800 | 300 | 100 | 1.1 | 0.27 | 8.0 |
| 66 | L | — | — | — | — | 50 | 12.0 | −35 | 860 | 150 | 50 | 0.8 | 0.63 | 10.0 |
| 67 | M | — | — | — | — | 50 | 15.0 | −35 | 830 | 150 | 100 | 1.0 | 0.18 | 15.0 |
| 68 | N | — | — | — | — | 50 | 10.0 | −40 | 800 | 200 | 100 | 0.7 | 0.22 | 10.0 |
| 69 | O | — | — | — | — | 50 | 10.0 | −40 | 810 | 100 | 50 | 1.3 | 0.24 | 10.0 |
| 70 | P | — | — | — | — | 50 | 10.0 | −35 | 850 | 100 | 50 | 0.9 | 0.08 | 10.0 |
| 71 | Q | — | — | — | — | 50 | 10.0 | −35 | 850 | 100 | 50 | 0.9 | 0.15 | 10.0 |
| 72 | R | — | — | — | — | 50 | 10.0 | −35 | 850 | 50 | 50 | 0.8 | 0.08 | 15.0 |

| | Second heating step | | | Galvanizing step | Alloying treatment step | | | | | | |
|---|---|---|---|---|---|---|---|---|---|---|---|
| No. | Dew point (° C.) | Heating temperature (° C.) | Holding time (s) | Al concentration (%) | Alloying temperature (° C.) | Tensile strength (MPa) | Total elongation (%) | Surface appearance | Adhesion | Product | Remarks |
| 41 | −40 | 820 | 80 | 0.138 | 530 | 1286 | 10.5 | A | A | GA | Inventive steel |
| 42 | −40 | 850 | 250 | 0.142 | 550 | 1255 | 11.1 | A | A | GA | Inventive steel |
| 43 | −30 | 800 | 150 | 0.176 | — | 1219 | 10.8 | A | A | GI | Inventive steel |
| 44 | −35 | 760 | 200 | 0.191 | — | 1194 | 11.8 | A | A | GI | Inventive steel |
| 45 | −35 | 840 | 100 | 0.134 | 500 | 791 | 22.1 | A | A | GA | Inventive steel |
| 46 | −35 | 750 | 150 | 0.189 | — | 807 | 21.9 | A | A | GI | Inventive steel |
| 47 | −35 | 800 | 100 | 0.131 | 500 | 819 | 20.9 | A | A | GA | Inventive steel |
| 48 | −35 | 780 | 50 | 0.195 | — | 821 | 21.8 | A | A | GI | Inventive steel |
| 49 | −40 | 820 | 150 | 0.210 | — | 1108 | 12.8 | A | A | GI | Inventive steel |
| 50 | −30 | 800 | 80 | 0.193 | — | 1216 | 10.8 | A | A | GI | Inventive steel |
| 51 | −35 | 840 | 100 | 0.137 | 540 | 1109 | 11.8 | A | A | GA | Inventive steel |
| 52 | −30 | 800 | 100 | 0.205 | — | 1201 | 11.1 | A | A | GI | Inventive steel |
| 53 | −35 | 790 | 150 | 0.133 | 560 | 1194 | 12.3 | A | A | GA | Inventive steel |
| 54 | −40 | 800 | 100 | 0.197 | — | 1322 | 10.7 | A | A | GI | Inventive steel |
| 55 | −30 | 840 | 100 | 0.132 | 550 | 1279 | 10.4 | A | A | GA | Inventive steel |
| 56 | −35 | 850 | 120 | 0.149 | — | 1249 | 10.5 | A | A | GI | Inventive steel |
| 57 | −35 | 760 | 200 | 0.130 | 550 | 1208 | 10.8 | A | A | GA | Inventive steel |
| 58 | −40 | 820 | 100 | 0.127 | 540 | 1187 | 12.4 | A | A | GA | Inventive steel |
| 59 | −30 | 760 | 150 | 0.194 | — | 806 | 21.2 | A | A | GI | Inventive steel |
| 60 | −35 | 760 | 100 | 0.137 | 510 | 814 | 21.8 | A | A | GA | Inventive steel |
| 61 | −35 | 810 | 50 | 0.137 | 520 | 791 | 22.4 | A | A | GA | Inventive steel |
| 62 | −40 | 820 | 100 | 0.132 | 490 | 994 | 17.4 | A | A | GA | Inventive steel |
| 63 | −30 | 760 | 150 | 0.189 | — | 895 | 20.5 | A | A | GI | Inventive steel |
| 64 | −30 | 840 | 50 | 0.189 | — | 905 | 17.8 | A | A | GI | Inventive steel |
| 65 | −25 | 750 | 100 | 0.132 | 490 | 924 | 16.5 | A | A | GA | Inventive steel |
| 66 | −35 | 850 | 50 | 0.138 | 490 | 791 | 20.8 | A | A | GA | Inventive steel |
| 67 | −30 | 800 | 100 | 0.178 | — | 1004 | 17.2 | A | A | GI | Inventive steel |
| 68 | −30 | 830 | 50 | 0.124 | 480 | 1197 | 12.2 | A | A | GA | Inventive steel |
| 69 | −40 | 800 | 100 | 0.195 | — | 995 | 17.4 | A | A | GI | Inventive steel |
| 70 | −35 | 820 | 150 | 0.190 | — | 1254 | 11.2 | A | A | GI | Inventive steel |

TABLE 3-continued

| | | | | | | | | | | | |
|---|---|---|---|---|---|---|---|---|---|---|---|
| 71 | −35 | 820 | 150 | 0.190 | — | 1207 | 11.8 | A | A | GI | Inventive steel |
| 72 | −35 | 800 | 150 | 0.137 | 540 | 880 | 20.8 | A | A | GA | Inventive steel |

TABLE 4

| | | Heat treatment step | | | | Cold rolling step | First heating step | | | | Cooling step | Rolling step | Pickling step | Second heating |
|---|---|---|---|---|---|---|---|---|---|---|---|---|---|---|
| No. | Steel | $H_2$ (%) | Dew point (° C.) | Heating temperature (° C.) | Holding time (s) | Rolling reduction (%) | $H_2$ (%) | Dew point (° C.) | Heating temperature (° C.) | Holding time (s) | Cooling temperature (° C.) | Rolling reduction (%) | Weight loss (g/m$^2$) | step $H_2$ (%) |
| 73 | A | — | — | — | — | 50 | 10.0 | −30 | 790 | 50 | 100 | 3.4 | 3.82 | 5.0 |
| 74 | A | — | — | — | — | 50 | 5.0 | −30 | 840 | 150 | 100 | 3.5 | 4.35 | 5.0 |
| 75 | A | — | — | — | — | 50 | 8.0 | −35 | 850 | 150 | 50 | 0.1 | 0.05 | 10.0 |
| 76 | A | — | — | — | — | 50 | 10.0 | −35 | 800 | 100 | 50 | 0.0 | 0.11 | 8.0 |
| 77 | A | — | — | — | — | 50 | 5.0 | −35 | 720 | 100 | 50 | 0.5 | 0.05 | 10.0 |
| 78 | A | — | — | — | — | 50 | 5.0 | −40 | 850 | 50 | 100 | 0.9 | 0.08 | 10.0 |
| 79 | B | — | — | — | — | 50 | 5.0 | −40 | 830 | 200 | 50 | 1.3 | 0.06 | 5.0 |
| 80 | B | — | — | — | — | 50 | 5.0 | −40 | 860 | 200 | 100 | 2.9 | 0.18 | 15.0 |
| 81 | B | — | — | — | — | 50 | 10.0 | −35 | 850 | 200 | 100 | 0.0 | 0.12 | 15.0 |
| 82 | B | — | — | — | — | 50 | 8.0 | −35 | 820 | 5 | 100 | 0.7 | 0.28 | 10.0 |
| 83 | B | — | — | — | — | 50 | 10.0 | −35 | 800 | 150 | 100 | 0.7 | 2.18 | 8.0 |
| 84 | B | — | — | — | — | 50 | 10.0 | −40 | 900 | 50 | 50 | 0.5 | 3.55 | 10.0 |
| 85 | C | — | — | — | — | 50 | 5.0 | −35 | 790 | 150 | 100 | 3.0 | 1.07 | 10.0 |
| 86 | C | — | — | — | — | 50 | 5.0 | −35 | 850 | 150 | 50 | 0.1 | 0.54 | 5.0 |
| 87 | C | — | — | — | — | 50 | 15.0 | −40 | 800 | 120 | 100 | 1.2 | 6.8 | 5.0 |
| 88 | C | — | — | — | — | 50 | 5.0 | −30 | 820 | 80 | 100 | 0.9 | 0.27 | 15.0 |
| 89 | C | — | — | — | — | 50 | 5.0 | −30 | 850 | 50 | 50 | 0.9 | — | 15.0 |
| 90 | C | — | — | — | — | 50 | 10.0 | −35 | 700 | 50 | 100 | 0.8 | 0.46 | 8.0 |
| 91 | D | — | — | — | — | 50 | 10.0 | −50 | 850 | 100 | 50 | 1.5 | 0.61 | 5.0 |
| 92 | D | — | — | — | — | 50 | 10.0 | −40 | 850 | 100 | 50 | 0.7 | 0.49 | 8.0 |
| 93 | D | — | — | — | — | 50 | 8.0 | −40 | 830 | 100 | 50 | 0.7 | 1.14 | 8.0 |
| 94 | D | — | — | — | — | 50 | 5.0 | −30 | 790 | 80 | 50 | 3.1 | 2.05 | 10.0 |
| 95 | D | — | — | — | — | 50 | 5.0 | −35 | 800 | 150 | 50 | 0.0 | 1.11 | 10.0 |
| 96 | D | — | — | — | — | 50 | 10.0 | −40 | 860 | 200 | 100 | 0.5 | 10.1 | 10.0 |
| 97 | E | — | — | — | — | 50 | 15.0 | −25 | 820 | 5 | 100 | 0.9 | 0.87 | 15.0 |
| 98 | F | — | — | — | — | 50 | 15.0 | −30 | 800 | 50 | 100 | 0.9 | 2.12 | 5.0 |
| 99 | Q | — | — | — | — | 50 | 10.0 | −50 | 800 | 100 | 50 | 0.4 | 1.25 | 5.0 |
| 100 | R | — | — | — | — | 50 | 5.0 | −35 | 710 | 5 | 50 | 0.5 | 0.84 | 5.0 |
| 101 | S | — | — | — | — | 50 | 10.0 | −30 | 800 | 100 | 100 | 0.6 | 0.50 | 5.0 |
| 102 | S | — | — | — | — | 50 | 10.0 | −30 | 850 | 100 | 50 | 0.9 | 1.60 | 5.0 |
| 103 | T | — | — | — | — | 50 | 10.0 | −35 | 860 | 150 | 100 | 1.4 | 1.20 | 5.0 |
| 104 | T | — | — | — | — | 50 | 10.0 | −40 | 820 | 150 | 100 | 0.7 | 0.90 | 5.0 |

| | Second heating step | | | Galvanizing step | Alloying treatment step | | | | | | |
|---|---|---|---|---|---|---|---|---|---|---|---|
| No. | Dew point (° C.) | Heating temperature (° C.) | Holding time (s) | Al concentration (%) | Alloying temperature (° C.) | Tensile strength (MPa) | Total elongation (%) | Surface appearance | Adhesion | Product | Remarks |
| 73 | −30 | 800 | 100 | 0.195 | — | 991 | 17.4 | B | B | GI | Comparative steel |
| 74 | −35 | 820 | 100 | 0.134 | 490 | 1004 | 16.8 | B | C | GA | Comparative steel |
| 75 | −35 | 800 | 150 | 0.190 | — | 1016 | 16.5 | A | B | GI | Comparative steel |
| 76 | −35 | 850 | 150 | 0.139 | 520 | 994 | 17.2 | A | C | GA | Comparative steel |
| 77 | −30 | 820 | 100 | 0.141 | 500 | 1010 | 16.6 | C | C | GA | Comparative steel |
| 78 | −30 | 890 | 200 | 0.139 | 540 | 1021 | 16.4 | C | C | GA | Comparative steel |
| 79 | −25 | 820 | 600 | 0.189 | — | 1218 | 13.2 | C | B | GI | Comparative steel |
| 80 | −35 | 800 | 50 | 0.134 | 520 | 1352 | 11.1 | B | C | GA | Comparative steel |
| 81 | −35 | 820 | 100 | 0.190 | — | 1109 | 14.8 | A | B | GI | Comparative steel |
| 82 | −30 | 750 | 100 | 0.190 | — | 1194 | 12.8 | C | B | GI | Comparative steel |
| 83 | 5 | 750 | 100 | 0.137 | 520 | 1212 | 11.6 | C | C | GA | Comparative steel |
| 84 | −40 | 830 | 200 | 0.131 | 530 | 1204 | 11.8 | C | C | GA | Comparative steel |
| 85 | −40 | 750 | 50 | 0.185 | — | 809 | 22.1 | B | B | GI | Comparative steel |
| 86 | −30 | 800 | 50 | 0.126 | 490 | 795 | 23.4 | B | C | GA | Comparative steel |
| 87 | −35 | 760 | 100 | 0.129 | 480 | 821 | 21.9 | C | C | GA | Comparative steel |
| 88 | −35 | 650 | 100 | 0.137 | 500 | 817 | 22.8 | C | C | GA | Comparative steel |
| 89 | −35 | 800 | 100 | 0.191 | — | 806 | 21.8 | C | B | GI | Comparative steel |
| 90 | −30 | 850 | 150 | 0.189 | — | 824 | 21.9 | C | B | GI | Comparative steel |
| 91 | −10 | 750 | 50 | 0.134 | 530 | 1207 | 12.1 | C | C | GA | Comparative steel |
| 92 | 5 | 800 | 50 | 0.129 | 560 | 1191 | 13.4 | C | C | GA | Comparative steel |
| 93 | −20 | 900 | 100 | 0.148 | — | 1004 | 17.4 | C | B | GI | Comparative steel |
| 94 | −30 | 750 | 100 | 0130 | 540 | 1018 | 17.1 | A | C | GA | Comparative steel |
| 95 | −30 | 800 | 100 | 0.181 | — | 1027 | 17.5 | A | B | GI | Comparative steel |
| 96 | −35 | 850 | 200 | 0.213 | — | 1128 | 14.9 | C | B | GI | Comparative steel |

TABLE 4-continued

| | | | | | | | | | | | |
|---|---|---|---|---|---|---|---|---|---|---|---|
| 97 | −35 | 800 | 150 | 0.139 | 510 | 1197 | 13.8 | C | C | GA | Comparative steel |
| 98 | −20 | 840 | 500 | 0.182 | — | 811 | 21.5 | C | B | GI | Comparative steel |
| 99 | −35 | 820 | 100 | 0.135 | 520 | 1244 | 11.9 | C | C | GA | Comparative steel |
| 100 | −30 | 850 | 100 | 0.132 | 540 | 971 | 18.6 | C | C | GA | Comparative steel |
| 101 | −30 | 790 | 200 | 0.192 | — | 812 | 22.1 | B | B | GI | Comparative steel |
| 102 | −30 | 820 | 100 | 0.130 | 500 | 792 | 21.5 | C | C | GA | Comparative steel |
| 103 | −30 | 800 | 50 | 0.189 | — | 997 | 17.5 | C | B | GI | Comparative steel |
| 104 | −30 | 800 | 100 | 0.132 | 560 | 957 | 17.9 | C | C | GA | Comparative steel |

TABLE 5

| | | Heat treatment step | | | | Cold rolling step | First heating step | | | | Cooling step | Rolling step | Pickling step | Second heating |
|---|---|---|---|---|---|---|---|---|---|---|---|---|---|---|
| No. | Steel | $H_2$ (%) | Dew point (° C.) | Heating temperature (° C.) | Holding time (s) | Rolling reduction (%) | $H_2$ (%) | Dew point (° C.) | Heating temperature (° C.) | Holding time (s) | Cooling temperature (° C.) | Rolling reduction (%) | Weight loss (g/m$^2$) | step $H_2$ (%) |
| 105 | A | 5 | −30 | 690 | 18000 | 50 | 8.0 | −40 | 850 | 150 | 100 | 0.5 | 0.05 | 5.0 |
| 106 | A | 5 | −20 | 640 | 18000 | 50 | 8.0 | −40 | 850 | 150 | 100 | 0.5 | 0.05 | 5.0 |
| 107 | A | 10 | −30 | 720 | 3600 | 50 | 8.0 | −40 | 850 | 150 | 100 | 0.5 | 0.05 | 5.0 |
| 108 | A | 10 | −30 | 680 | 7200 | 50 | 8.0 | −40 | 850 | 150 | 100 | 0.9 | 0.07 | 5.0 |
| 109 | A | 5 | −30 | 750 | 15000 | 80 | 8.0 | −40 | 850 | 150 | 100 | 0.9 | 0.07 | 5.0 |
| 110 | A | 5 | −30 | 700 | 20000 | 35 | 8.0 | −40 | 850 | 150 | 100 | 0.9 | 0.07 | 5.0 |
| 111 | A | 5 | −30 | 800 | 7200 | 50 | 8.0 | −40 | 850 | 150 | 100 | 0.9 | 0.07 | 5.0 |
| 112 | B | 5 | −20 | 680 | 18000 | 50 | 10.0 | −35 | 820 | 150 | 100 | 0.5 | 0.05 | 5.0 |
| 113 | B | 5 | −30 | 690 | 11000 | 65 | 10.0 | −35 | 820 | 150 | 100 | 0.5 | 0.05 | 5.0 |
| 114 | B | 5 | −30 | 650 | 7200 | 50 | 10.0 | −35 | 820 | 150 | 100 | 0.5 | 0.05 | 5.0 |
| 115 | B | 5 | −30 | 680 | 18000 | 50 | 10.0 | −30 | 810 | 150 | 100 | 0.9 | 0.12 | 5.0 |
| 116 | B | 10 | −30 | 680 | 1200 | 50 | 10.0 | −30 | 810 | 150 | 100 | 0.9 | 0.12 | 5.0 |
| 117 | B | 5 | −30 | 700 | 14400 | 45 | 10.0 | −30 | 810 | 150 | 100 | 0.9 | 0.12 | 5.0 |
| 118 | B | 5 | −40 | 780 | 11000 | 50 | 10.0 | −30 | 810 | 150 | 100 | 0.9 | 0.12 | 5.0 |
| 119 | C | 5 | −30 | 670 | 18000 | 50 | 10.0 | −30 | 820 | 150 | 50 | 0.9 | 0.09 | 5.0 |
| 120 | C | 5 | −30 | 700 | 7200 | 60 | 10.0 | −30 | 820 | 150 | 50 | 0.9 | 0.09 | 5.0 |
| 121 | C | 5 | −30 | 800 | 7200 | 45 | 10.0 | −30 | 820 | 150 | 50 | 0.9 | 0.09 | 5.0 |
| 122 | D | 5 | −20 | 820 | 15000 | 70 | 10.0 | −35 | 820 | 150 | 100 | 0.5 | 0.05 | 5.0 |
| 123 | D | 5 | −30 | 700 | 20000 | 40 | 10.0 | −35 | 820 | 150 | 100 | 0.5 | 0.05 | 5.0 |
| 124 | D | 15 | −30 | 690 | 18000 | 50 | 10.0 | −35 | 820 | 150 | 100 | 0.5 | 0.05 | 5.0 |
| 125 | E | 5 | −30 | 700 | 11000 | 50 | 5.0 | −30 | 840 | 450 | 50 | 0.9 | 0.64 | 10.0 |
| 126 | E | 5 | −30 | 740 | 10000 | 50 | 5.0 | −35 | 820 | 150 | 100 | 1.2 | 0.29 | 10.0 |
| 127 | F | 5 | 0 | 740 | 15000 | 50 | 15.0 | −30 | 850 | 100 | 100 | 0.8 | 0.84 | 5.0 |
| 128 | F | 5 | −30 | 680 | 12000 | 50 | 10.0 | −35 | 810 | 100 | 50 | 1.5 | 0.53 | 10.0 |
| 129 | G | 5 | −30 | 690 | 12000 | 50 | 8.0 | −35 | 860 | 50 | 50 | 1.2 | 1.22 | 15.0 |
| 130 | H | 5 | −30 | 720 | 12000 | 50 | 7.0 | −30 | 810 | 150 | 50 | 0.7 | 0.23 | 15.0 |
| 131 | I | 5 | −20 | 720 | 12000 | 50 | 5.0 | −30 | 820 | 100 | 100 | 1.4 | 0.34 | 5.0 |
| 132 | J | 5 | −30 | 700 | 12000 | 50 | 15.0 | −35 | 860 | 100 | 100 | 0.8 | 0.54 | 12.0 |
| 133 | K | 5 | −30 | 750 | 12000 | 50 | 5.0 | −40 | 800 | 200 | 100 | 0.7 | 0.52 | 15.0 |
| 134 | L | 5 | −30 | 720 | 12000 | 50 | 12.0 | −35 | 860 | 150 | 50 | 0.8 | 0.63 | 10.0 |
| 135 | M | 5 | −30 | 690 | 12000 | 50 | 15.0 | −35 | 830 | 150 | 100 | 1.0 | 0.18 | 15.0 |
| 136 | N | 5 | −30 | 650 | 12000 | 50 | 10.0 | −40 | 800 | 200 | 100 | 0.7 | 0.22 | 10.0 |
| 137 | O | 5 | −30 | 700 | 12000 | 50 | 10.0 | −40 | 810 | 100 | 50 | 1.3 | 0.24 | 10.0 |
| 138 | P | 5 | −30 | 700 | 12000 | 50 | 10.0 | −35 | 850 | 100 | 50 | 0.9 | 0.08 | 10.0 |
| 139 | Q | 5 | −30 | 720 | 12000 | 50 | 10.0 | −35 | 850 | 100 | 50 | 0.9 | 0.15 | 10.0 |
| 140 | R | 5 | −30 | 690 | 12000 | 50 | 10.0 | −35 | 850 | 50 | 50 | 0.8 | 0.08 | 15.0 |
| 141 | U | 5 | −30 | — | — | 50 | 5.0 | −40 | 780 | 150 | 100 | 0.5 | 0.09 | 10.0 |
| 142 | U | 10 | −30 | 700 | 3600 | 70 | 5.0 | −40 | 780 | 150 | 100 | 0.5 | 0.09 | 10.0 |
| 143 | U | 5 | −40 | 670 | 18000 | 50 | 5.0 | −40 | 780 | 150 | 100 | 0.5 | 0.09 | 10.0 |
| 144 | U | 5 | −30 | 670 | 18000 | 50 | 5.0 | −40 | 780 | 150 | 100 | 0.5 | 0.09 | 10.0 |
| 145 | U | 15 | −10 | 670 | 18000 | 50 | 5.0 | −40 | 780 | 150 | 100 | 0.5 | 0.09 | 10.0 |
| 146 | U | 5 | −30 | 690 | 8000 | 40 | 5.0 | −40 | 780 | 150 | 100 | 0.5 | 0.09 | 10.0 |
| 147 | U | 5 | −30 | 760 | 21000 | 50 | 5.0 | −40 | 780 | 150 | 100 | 0.5 | 0.09 | 10.0 |
| 148 | V | 5 | −30 | — | — | 50 | 5.0 | −35 | 790 | 100 | 100 | 0.4 | 0.14 | 15.0 |
| 149 | V | 5 | −30 | 690 | 3600 | 50 | 5.0 | −35 | 790 | 100 | 100 | 0.4 | 0.14 | 15.0 |
| 150 | V | 5 | −10 | 740 | 10000 | 50 | 10.0 | −35 | 810 | 50 | 80 | 0.4 | 0.12 | 15.0 |
| 151 | V | 10 | −30 | 740 | 10000 | 50 | 10.0 | −35 | 810 | 50 | 80 | 0.4 | 0.12 | 15.0 |
| 152 | V | 5 | −30 | 700 | 18000 | 50 | 10.0 | −40 | 810 | 50 | 80 | 0.4 | 0.11 | 5.0 |
| 153 | V | 5 | −30 | 690 | 21000 | 50 | 10.0 | −35 | 810 | 50 | 80 | 0.4 | 0.07 | 15.0 |
| 154 | W | 5 | −30 | — | — | 50 | 10.0 | −40 | 780 | 150 | 100 | 0.7 | 0.08 | 10.0 |
| 155 | W | 5 | −30 | 690 | 3600 | 50 | 10.0 | −40 | 780 | 150 | 100 | 0.7 | 0.08 | 10.0 |
| 156 | W | 5 | −10 | 740 | 9000 | 50 | 10.0 | −40 | 780 | 150 | 100 | 0.7 | 0.08 | 10.0 |
| 157 | W | 10 | −30 | 700 | 18000 | 50 | 10.0 | −40 | 780 | 150 | 100 | 0.7 | 0.08 | 10.0 |
| 158 | W | 5 | −40 | 690 | 21000 | 50 | 10.0 | −40 | 780 | 150 | 100 | 0.7 | 0.08 | 10.0 |

TABLE 5-continued

| No. | Second heating step: Dew point (° C.) | Second heating step: Heating temperature (° C.) | Second heating step: Holding time (s) | Galvanizing step: Al concentration (%) | Alloying treatment step: Alloying temperature (° C.) | Tensile strength (MPa) | Total elongation (%) | Surface appearance | Adhesion | Product | Remarks |
|---|---|---|---|---|---|---|---|---|---|---|---|
| 105 | −35 | 800 | 100 | 0.193 | — | 823 | 28.7 | A | A | GI | Inventive steel |
| 106 | −35 | 800 | 100 | 0.193 | — | 835 | 27.5 | A | A | GI | Inventive steel |
| 107 | −35 | 800 | 100 | 0.193 | — | 830 | 28.4 | A | A | GI | Inventive steel |
| 108 | −35 | 800 | 50 | 0.137 | 520 | 826 | 27.6 | A | A | GA | Inventive steel |
| 109 | −35 | 800 | 50 | 0.137 | 520 | 821 | 28.7 | A | A | GA | Inventive steel |
| 110 | −35 | 800 | 50 | 0.137 | 520 | 830 | 28.1 | A | A | GA | Inventive steel |
| 111 | −35 | 800 | 50 | 0.137 | 520 | 824 | 28.3 | A | A | GA | Inventive steel |
| 112 | −35 | 780 | 100 | 0.192 | — | 1123 | 16.7 | A | A | GI | Inventive steel |
| 113 | −35 | 780 | 100 | 0.192 | — | 1134 | 16.4 | A | A | GI | Inventive steel |
| 114 | −35 | 780 | 100 | 0.192 | — | 1129 | 16.4 | A | A | GI | Inventive steel |
| 115 | −35 | 780 | 100 | 0.137 | 520 | 1205 | 15.4 | A | A | GA | Inventive steel |
| 116 | −35 | 780 | 100 | 0.137 | 520 | 1198 | 15.1 | A | A | GA | Inventive steel |
| 117 | −35 | 780 | 100 | 0.137 | 520 | 1208 | 15.2 | A | A | GA | Inventive steel |
| 118 | −35 | 780 | 100 | 0.137 | 520 | 1195 | 15.6 | A | A | GA | Inventive steel |
| 119 | −35 | 780 | 80 | 0.137 | 520 | 894 | 26.4 | A | A | GA | Inventive steel |
| 120 | −35 | 780 | 80 | 0.137 | 520 | 859 | 26.7 | A | A | GA | Inventive steel |
| 121 | −35 | 780 | 80 | 0.137 | 520 | 873 | 25.8 | A | A | GA | Inventive steel |
| 122 | −35 | 790 | 50 | 0.148 | — | 1254 | 13.4 | A | A | GI | Inventive steel |
| 123 | −35 | 790 | 50 | 0.148 | — | 1249 | 13.3 | A | A | GI | Inventive steel |
| 124 | −35 | 790 | 50 | 0.148 | — | 1257 | 13.1 | A | A | GI | Inventive steel |
| 125 | −40 | 850 | 250 | 0.142 | 550 | 1255 | 13.5 | A | A | GA | Inventive steel |
| 126 | −30 | 800 | 150 | 0.176 | — | 1219 | 13.7 | A | A | GI | Inventive steel |
| 127 | −35 | 840 | 100 | 0.134 | 500 | 791 | 29.4 | A | A | GA | Inventive steel |
| 128 | −35 | 750 | 150 | 0.189 | — | 807 | 29.8 | A | A | GI | Inventive steel |
| 129 | −35 | 790 | 150 | 0.133 | 560 | 1194 | 13.4 | A | A | GA | Inventive steel |
| 130 | −40 | 800 | 100 | 0.197 | — | 1322 | 12.8 | A | A | GI | Inventive steel |
| 131 | −30 | 760 | 150 | 0.194 | — | 806 | 28.4 | A | A | GI | Inventive steel |
| 132 | −40 | 820 | 100 | 0.132 | 490 | 994 | 22.4 | A | A | GA | Inventive steel |
| 133 | −30 | 760 | 150 | 0.189 | — | 895 | 24.6 | A | A | GI | Inventive steel |
| 134 | −35 | 850 | 50 | 0.138 | 490 | 791 | 28.5 | A | A | GA | Inventive steel |
| 135 | −30 | 800 | 100 | 0.178 | — | 1004 | 21.9 | A | A | GI | Inventive steel |
| 136 | −30 | 830 | 50 | 0.124 | 480 | 1197 | 15.2 | A | A | GA | Inventive steel |
| 137 | −40 | 800 | 100 | 0.195 | — | 995 | 21.7 | A | A | GI | Inventive steel |
| 138 | −35 | 820 | 150 | 0.190 | — | 1254 | 12.8 | A | A | GI | Inventive steel |
| 139 | −35 | 820 | 150 | 0.190 | — | 1207 | 13.1 | A | A | GI | Inventive steel |
| 140 | −35 | 800 | 150 | 0.137 | 540 | 880 | 28.6 | A | A | GA | Inventive steel |
| 141 | −40 | 740 | 100 | 0.134 | 520 | 1158 | 14.4 | A | A | GA | Inventive steel |
| 142 | −30 | 740 | 100 | 0.134 | 520 | 1028 | 24.1 | A | A | GA | Inventive steel |
| 143 | −50 | 740 | 100 | 0.134 | 520 | 1036 | 23.4 | A | A | GA | Inventive steel |
| 144 | −40 | 730 | 150 | 0.189 | — | 1008 | 25.2 | A | A | GI | Inventive steel |
| 145 | −40 | 730 | 150 | 0.189 | — | 1016 | 24.7 | A | A | GI | Inventive steel |
| 146 | −40 | 740 | 100 | 0.134 | 520 | 1035 | 23.7 | A | A | GA | Inventive steel |
| 147 | −35 | 740 | 100 | 0.134 | 520 | 1024 | 23.8 | A | A | GA | Inventive steel |
| 148 | −45 | 800 | 100 | 0.132 | 500 | 1236 | 13.5 | A | A | GA | Inventive steel |
| 149 | −50 | 800 | 100 | 0.132 | 500 | 1186 | 15.2 | A | A | GA | Inventive steel |
| 150 | −40 | 730 | 50 | 0.141 | 540 | 1058 | 24.5 | A | A | GA | Inventive steel |
| 151 | −40 | 730 | 50 | 0.194 | — | 1067 | 24.1 | A | A | GI | Inventive steel |
| 152 | −45 | 740 | 50 | 0.137 | 500 | 1071 | 23.5 | A | A | GA | Inventive steel |
| 153 | −50 | 800 | 150 | 0.135 | 500 | 1179 | 16.1 | A | A | GA | Inventive steel |
| 154 | −40 | 730 | 100 | 0.131 | 510 | 991 | 15.4 | A | A | GA | Inventive steel |
| 155 | −40 | 730 | 100 | 0.131 | 510 | 1002 | 24.9 | A | A | GA | Inventive steel |
| 156 | −50 | 750 | 150 | 0.138 | 520 | 1032 | 20.5 | A | A | GA | Inventive steel |
| 157 | −40 | 750 | 150 | 0.137 | 520 | 1028 | 19.8 | A | A | GA | Inventive steel |
| 158 | −40 | 750 | 150 | 0.132 | 500 | 1038 | 21.2 | A | A | GA | Inventive steel |

TABLE 6

| No. | Steel | Heat treatment step: $H_2$ (%) | Heat treatment step: Dew point (° C.) | Heat treatment step: Heating temperature (° C.) | Heat treatment step: Holding time (s) | Cold rolling step: Rolling reduction (%) | First heating step: $H_2$ (%) | First heating step: Dew point (° C.) | First heating step: Heating temperature (° C.) | First heating step: Holding time (s) | Cooling step: Cooling temperature (° C.) | Rolling step: Rolling reduction (%) | Pickling step: Weight loss (g/m$^2$) | Second heating step $H_2$ (%) |
|---|---|---|---|---|---|---|---|---|---|---|---|---|---|---|
| 159 | U | 0.01 | −30 | 690 | 18000 | 50 | 5.0 | −35 | 790 | 100 | 100 | 0.4 | 0.14 | 15.0 |
| 160 | U | 5 | 20 | 670 | 18000 | 50 | 5.0 | −40 | 780 | 150 | 100 | 0.5 | 0.08 | 10.0 |
| 161 | U | 0.01 | −10 | 760 | 21000 | 50 | 5.0 | −40 | 780 | 150 | 100 | 0.5 | 0.09 | 10.0 |
| 162 | U | 5 | 30 | 700 | 3600 | 70 | 5.0 | −40 | 780 | 150 | 100 | 0.5 | 0.09 | 10.0 |

TABLE 6-continued

| | | | | | | | | | | | | | | |
|---|---|---|---|---|---|---|---|---|---|---|---|---|---|---|
| 163 | V | 5 | 30 | 690 | 3600 | 50 | 5.0 | −35 | 790 | 100 | 100 | 0.4 | 0.14 | 15.0 |
| 164 | V | 0.01 | −30 | 740 | 10000 | 50 | 10.0 | −35 | 810 | 50 | 80 | 0.4 | 0.12 | 15.0 |
| 165 | V | 15 | 25 | 700 | 18000 | 50 | 10.0 | −40 | 810 | 50 | 80 | 0.4 | 0.11 | 5.0 |
| 166 | V | 5 | 20 | 740 | 10000 | 50 | 10.0 | −35 | 810 | 50 | 80 | 0.4 | 0.12 | 15.0 |
| 167 | W | 0.01 | −30 | 690 | 3600 | 50 | 10.0 | −40 | 780 | 150 | 100 | 0.7 | 0.08 | 10.0 |
| 168 | W | 5 | 30 | 740 | 9000 | 50 | 10.0 | −40 | 780 | 150 | 100 | 0.7 | 0.08 | 10.0 |
| 169 | W | 0.01 | −40 | 690 | 21000 | 50 | 10.0 | −40 | 780 | 150 | 100 | 0.7 | 0.08 | 10.0 |
| 170 | W | 5 | 20 | 700 | 18000 | 50 | 10.0 | −40 | 780 | 150 | 100 | 0.7 | 0.08 | 10.0 |

| | Second heating step | | | Galvanizing step | Alloying treatment step | | | | | | |
|---|---|---|---|---|---|---|---|---|---|---|---|
| No. | Dew point (° C.) | Heating temperature (° C.) | Holding time (s) | Al concentration (%) | Alloying temperature (° C.) | Tensile strength (MPa) | Total elongation (%) | Surface appearance | Adhesion | Product | Remarks |
| 159 | −50 | 800 | 100 | 0.132 | 500 | 1186 | 15.1 | A | A | GA | Inventive steel |
| 160 | −40 | 730 | 150 | 0.189 | — | 1008 | 18.9 | A | A | GI | Inventive steel |
| 161 | −35 | 740 | 100 | 0.134 | 520 | 1024 | 19.2 | A | A | GA | Inventive steel |
| 162 | −30 | 740 | 100 | 0.134 | 520 | 1028 | 19.5 | A | A | GA | Inventive steel |
| 163 | −50 | 800 | 100 | 0.132 | 500 | 1186 | 15.0 | A | A | GA | Inventive steel |
| 164 | −40 | 730 | 50 | 0.141 | 540 | 1058 | 13.9 | A | A | GA | Inventive steel |
| 165 | −45 | 740 | 50 | 0.137 | 500 | 1071 | 14.9 | A | A | GA | Inventive steel |
| 166 | −40 | 730 | 50 | 0.194 | — | 1067 | 14.9 | A | A | GI | Inventive steel |
| 167 | −40 | 730 | 100 | 0.131 | 510 | 1002 | 17.9 | A | A | GA | Inventive steel |
| 168 | −50 | 750 | 150 | 0.138 | 520 | 1032 | 15.8 | A | A | GA | Inventive steel |
| 169 | −40 | 750 | 150 | 0.132 | 500 | 1038 | 15.9 | A | A | GA | Inventive steel |
| 170 | −40 | 750 | 150 | 0.137 | 520 | 1028 | 15.1 | A | A | GA | Inventive steel |

High-strength galvanized steel sheets of examples of the present disclosure have a TS of 780 MPa or more and are excellent in surface appearance and coating adhesion. However, in comparative examples, one or more of surface appearance and coating adhesion are poor.

High-strength galvanized steel sheets of examples of the present disclosure are increased in total elongation by performing the heat treatment step. For example, in comparisons between the total elongation of Nos. 1 to 10, in which A steel is used, and the total elongation of Nos. 105 to 111, the total elongation of Nos. 105 to 111, in which the heat treatment step was performed, is high. For Nos. 141 to 147, in which U steel is used, the total elongation of Nos. 142 to 147, in which the heat treatment step was performed, is high.

The invention claimed is:

1. A method for manufacturing a high-strength galvanized steel sheet, the method comprising:

a first heating step of holding a steel sheet in a temperature range of 750° C. to 880° C. for 20 sec. to 600 sec. in an atmosphere having an $H_2$ concentration of 0.05% to 25.0% by volume and a dew point of −45° C. to −10° C., the steel sheet including:

0.040% to 0.500% C, by mass %,
0.80% or less Si, by mass %,
1.80% to 4.00% Mn, by mass %,
0.100% or less P, by mass %,
0.0100% or less S, by mass %,
0.100% or less Al, by mass %, and
0.0100% or less N, by mass %,
the remainder being Fe and inevitable impurities;

a cooling step of cooling the steel sheet after the first heating step;

a rolling step of rolling the steel sheet with a rolling reduction of 0.3% to 2.0% after the cooling step;

a pickling step of pickling the steel sheet with a pickling weight loss of 0.02 gram/$m^2$ to 5 gram/$m^2$ in terms of Fe after the rolling step;

a second heating step of holding the steel sheet in a temperature range of 720° C. to 860° C. for 20 sec. to 300 sec. in an atmosphere having an $H_2$ concentration of 0.05% to 25.0% by volume and a dew point of −10° C. or lower after the pickling step; and a galvanizing step of galvanizing the steel sheet after the second heating step, wherein in the manufacture of the steel sheet subjected to the first heating step, after the steel sheet is hot-rolled and is then descaled by a pickling, a heat treatment step is performed in such a manner that the steel sheet is held at a temperature of 600° C. or higher for 600 sec. to 21,600 sec. in an atmosphere having an $H_2$ concentration of 1.0% to 25.0% by volume and a dew point of 10° C. or lower in such a state that no surface of the steel sheet is exposed to the atmosphere.

2. The method for manufacturing the high-strength galvanized steel sheet according to claim 1, wherein the steel sheet further includes at least one element selected from 0.010% to 0.100% Ti, by mass %, 0.010% to 0.100% Nb, by mass %, and 0.0001% to 0.0050% B, by mass %.

3. The method for manufacturing the high-strength galvanized steel sheet according to claim 2, wherein the steel sheet further includes at least one element selected from 0.01% to 0.50% Mo, by mass %, 0.30% or less Cr, by mass %, 0.50% or less Ni, by mass %, 1.00% or less Cu, by mass %, 0.500% or less V, by mass %, 0.10% or less Sb, by mass %, 0.10% or less Sn, by mass %, 0.0100% or less Ca, by mass %, and 0.010% or less of a REM, by mass %.

4. The method for manufacturing the high-strength galvanized steel sheet according to claim 1, wherein the steel sheet further includes at least one element selected from 0.01% to 0.50% Mo, by mass %, 0.30% or less Cr, by mass %, 0.50% or less Ni, by mass %, 1.00% or less Cu, by mass %, 0.500% or less V, by mass %, 0.10% or less Sb, by mass %, 0.10% or less Sn, by mass %, 0.0100% or less Ca, by mass %, and 0.010% or less of a REM, by mass %.

5. The method for manufacturing the high-strength galvanized steel sheet according to any one of claims 1-4 further comprising an alloying treatment step of alloying the steel sheet after the galvanizing step.

* * * * *